US005082085A

United States Patent [19]

Ream et al.

[11] Patent Number: 5,082,085

[45] Date of Patent: Jan. 21, 1992

[54] PLATFORM LEVELING APPARATUS

[75] Inventors: Michael D. Ream, Lafayette; Gerald L. Claxton, Fresno, both of Calif.

[73] Assignee: Up-Right, Inc., Oakland, Calif.

[21] Appl. No.: 575,233

[22] Filed: Aug. 30, 1990

[51] Int. Cl.[5] ..... B66F 11/04

[52] U.S. Cl. ..... 182/2; 182/148

[58] Field of Search ..... 182/2, 148, 128

[56] References Cited

U.S. PATENT DOCUMENTS

| | | | |
|---|---|---|---|
| 3,584,705 | 6/1971 | Ruegg | 182/2 X |
| 3,891,056 | 6/1975 | Ashworth | 182/2 X |
| 4,169,511 | 10/1979 | Brown | 182/2 X |
| 4,558,758 | 12/1985 | Littman et al. | 182/2 X |
| 4,565,486 | 1/1986 | Crawford et al. | 182/2 X |
| 4,762,199 | 8/1988 | Holmes | 182/2 |
| 4,953,666 | 9/1990 | Ridings | 182/2 X |

FOREIGN PATENT DOCUMENTS

| | | | |
|---|---|---|---|
| 2357470 | 8/1973 | Fed. Rep. of Germany | 182/2 |

*Primary Examiner*—Alvin C. Chin-Shue

*Attorney, Agent, or Firm*—Phillips, Moore, Lempio & Finley

[57] ABSTRACT

A mobile aerial lift platform vehicle of the type having an upstanding pedestal and an elevating assembly mounted on the pedestal to raise and lower the work platform while maintaining the center of gravity of the platform within the base area defined by the wheels of the vehicle. The improvement is that the pedestal is pivotally mounted to the chassis of the vehicle for pivotal movement about a first axis extending fore and aft of the chassis and about a second axis extending from side to side of the chassis. Two hydraulic rams for provided, each of which will pivot the pedestal about one only of the axes, so that the pedestal may be leveled even through the vehicle is on unlevel ground.

12 Claims, 5 Drawing Sheets

PLATFORM LEVELING APPARATUS

TECHNICAL FIELD

This invention relates to mobile aerial lift vehicles and more particularly to a system for leveling the elevating assembly for the work platform of such vehicles.

BACKGROUND ART

Mobile aerial lift vehicles are in common use for lifting workman at a job site to a height where they can work on elevated structures. Typically, these vehicles are four-wheeled and have an elevating assembly mounted on the vehicle chassis for raising and lowering the work platform.

Users often have requirements not easily met by existing equipment. In particular, work must often be on uneven or unlevel ground, e.g. outside a building, inside a building before the floor has been laid, on ramps, in theaters with a sloping floor, or any other job site where the ground is not smooth and level. There are two main current solutions to being able to operate an aerial lift on these types of ground conditions.

First, if a mobile aerial lift vehicle with a relatively large area work platform that is raised and lowered vertically by an articulated or scissors type elevating assembly with the center of gravity remaining within the area defined by the vehicle, is to be used on rough terrain, the vehicle is provided with a hydraulically operated outrigger at each of the four wheels. These outriggers are independently controlled to raise the four corners of the chassis so that the entire vehicle is leveled relative to the horizon. Manual leveling of the entire vehicle is difficult and time consuming. If the ground is sloping in two directions, undesirable rocking of the vehicle will occur if all four outrigger pads are not kept in ground engagement during leveling. Further, these outrigger systems are expensive, since they require a hydraulic cylinder at each corner of the vehicle, a control valve for each cylinder, and all the inherent plumbing required for such a system.

The other type of aerial lift vehicle that can be used on rough terrain is the boom, or cherry-picker, type of lift. The vehicle can be used at an uneven ground site, with the work platform at the end of the boom being self-leveling relative to the boom and vehicle. These vehicles, however, are much more expensive than the previously mentioned vehicle with articulated lift assemblies. Also, since the work platform at the end of the boom will often be at a relatively large horizontal distance from the support area of the vehicle, the work platform must be relatively small and with a low capacity.

SUMMARY OF THE INVENTION

The present invention is directed towards overcoming one or more of the problems set forth above.

In the broadest aspect of the invention, a mobile aerial lift vehicle with a conventional elevating assembly for the work platform is constructed for rough terrain usage so that instead of leveling the entire vehicle relative to the horizon, only the pedestal which carries the elevating assembly is so leveled.

In a further aspect of this invention, the pedestal is mounted on the chassis for pivotal movement about a first axis extending fore and aft of the chassis and for pivotal movement about a second axis extending generally side to side of the chassis. Means are provided for pivoting the pedestal about each of the two axes of pivotal movement.

Other aspects of the invention will be set forth in the course of the following detailed description.

BRIEF DESCRIPTION OF THE DRAWINGS

In the drawings, forming a part of this application, and in which like parts are designated by like reference numerals throughout the same.

DESCRIPTION OF THE PREFERRED EMBODIMENT

Figure 2:
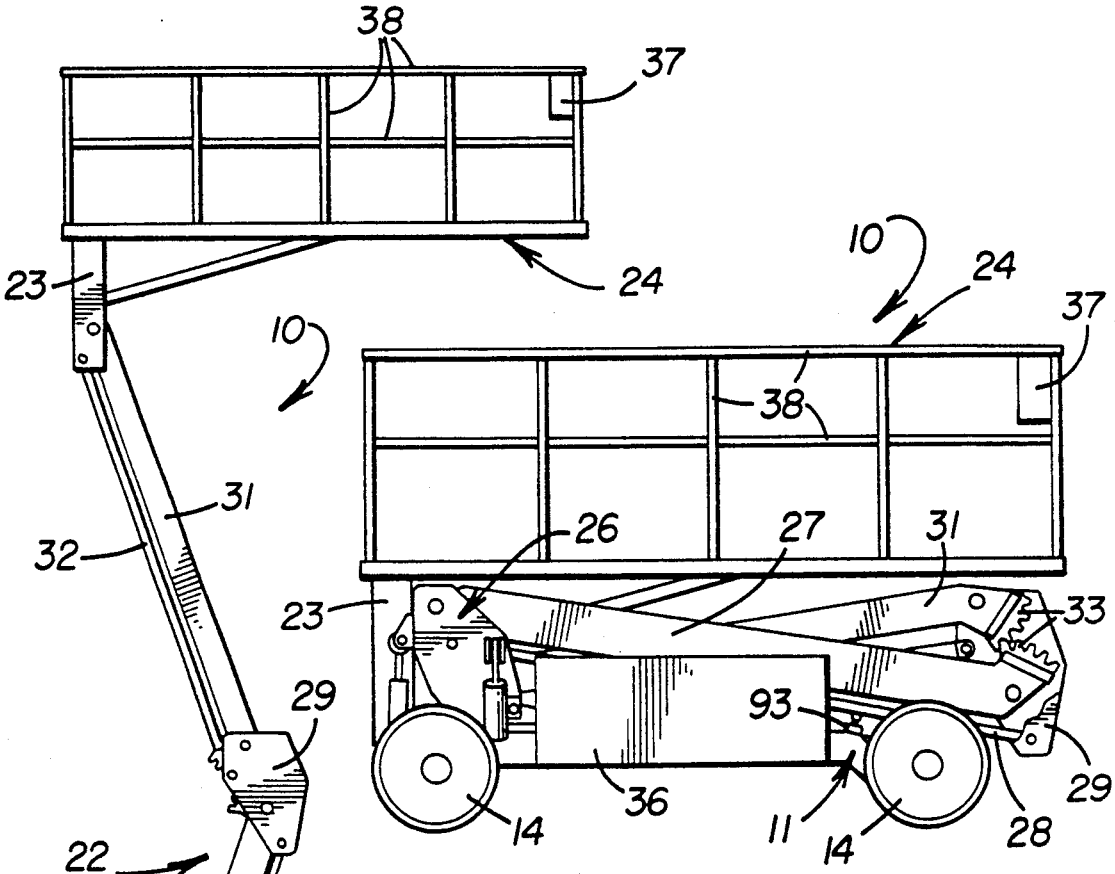
FIG. 2 is similar to FIG. 1, showing the platform in lowered position, and with part of the housing for the elevating assembly cut away for purposes of illustration.
Figure 1:
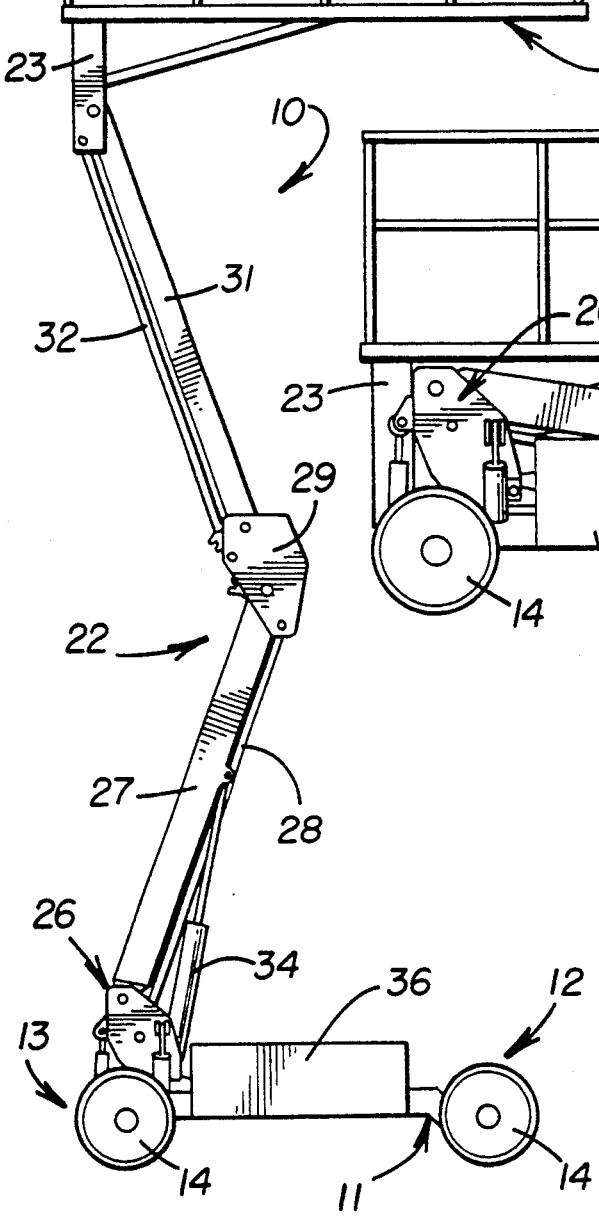
FIG. 1 is a simplified side view of a mobil aerial work platform vehicle utilizing the principles of the present invention, and showing the platform in elevated position.
Figure 4:
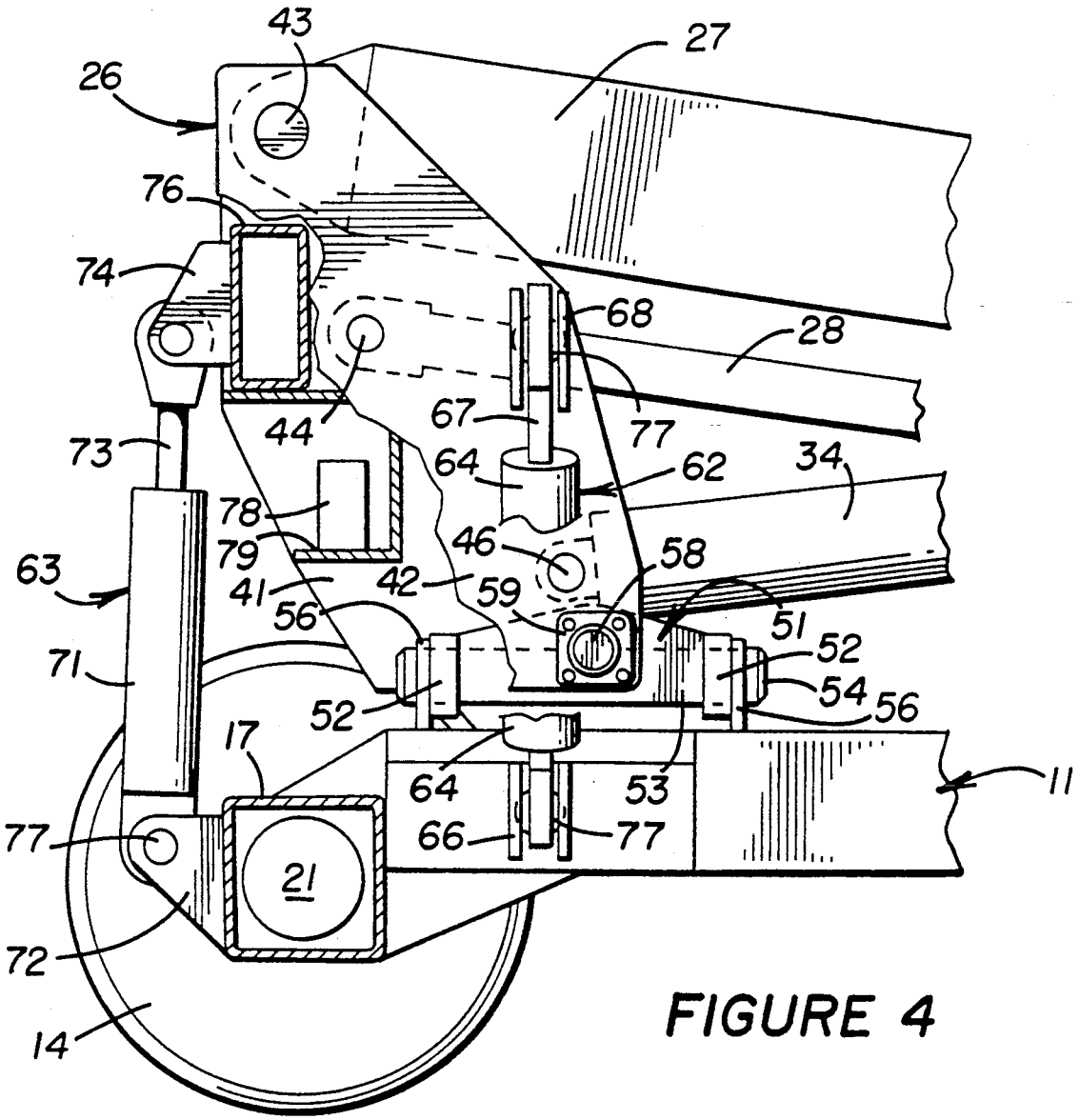
FIG. 4 is a partial side view of the rear end of the vehicle of FIG. 1.

In the drawings, wherein a preferred embodiment of the invention is shown, the mobile aerial work platform vehicle 10 has a chassis 11 with front and rear ends 12 and 13, and two spaced-apart ground-engaging wheels 14 at each end of the front and rear axles 16 and 17 of the vehicle. For a four-wheel drive, each wheel 14 may be driven in a desired direction by individual hydraulic motors 21 at each end of the front and rear axles. An articulated linkage arm elevating assembly 22, connected to the platform support 23 o the work platform 24 and to pedestal 26 on the chassis, is provided to raise and lower the platform 24. In general, the elevating assembly 22 includes a lower boom 27 and lower tension arm 28 pivotally connected to mast 26 and to housing 29, and an upper boom 31 and upper tension arm 32 pivotally connected to housing 29 and platform support 23, the upper and lower booms 31 and 27 being connected together for articulated movement by intermeshed gear segments 33 secured thereto. A hydraulic lift ram 34 is connected between pedestal 26 and the lower boom 27 and will raise or lower the platform 24 upon extension or retraction of the ram. Sector gear segments 33 will raise or lower the upper boom 31 in response to raising or lowering of the lower boom 27, and the lower and upper tension arms 28 and 32 will maintain the platform level relative to pedestal 26 during raising and lowering. This type of elevating assembly will maintain the center of gravity of the work platform within the rectangular base defined by the points of engagement of the wheels 14 with the ground at all times during raising and lowering of the platform as long as pedestal 26 is level relative to the horizon. One or more modules 36 are mounted on chassis 11 to contain the electrical and hydraulic systems of the vehicle. A control panel 37 mounted on a guard rail 38 of the work platform is provided for the operator to use in driving the vehicle and in raising and lowering the platform. As best seen in FIG. 4, the pedestal 26 comprises two parallel side plates 41 and 42, and pivot pins 43, 44, and 46 extending between these plates for the pivotal support, respectively, of the lower boom 27, the lower tension arm 28 and the lift ram 34. The structure described thus far is conventional for this type of vehicle.

In previous machines of this general type, the pedestal 26 has been directly fixed to the chassis, which has necessitated the entire vehicle being leveled by outriggers before the platform could be elevated. The present invention differs in that the pedestal 26 is pivotally mounted on the chassis so that the pedestal 26 can be leveled relative to the horizon when the chassis is not level (e.g. on sloping ground).

Figure 3:
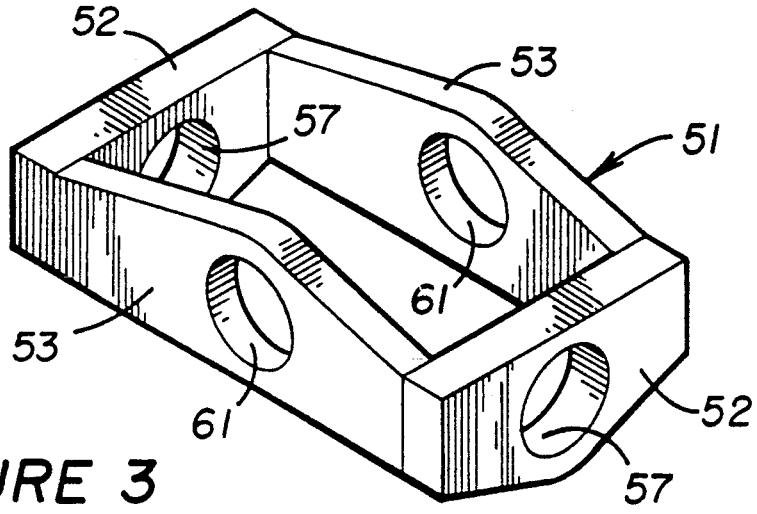
FIG. 3 is a perspective view of the intermediate frame member connecting the pedestal and the chassis.
Figure 5:
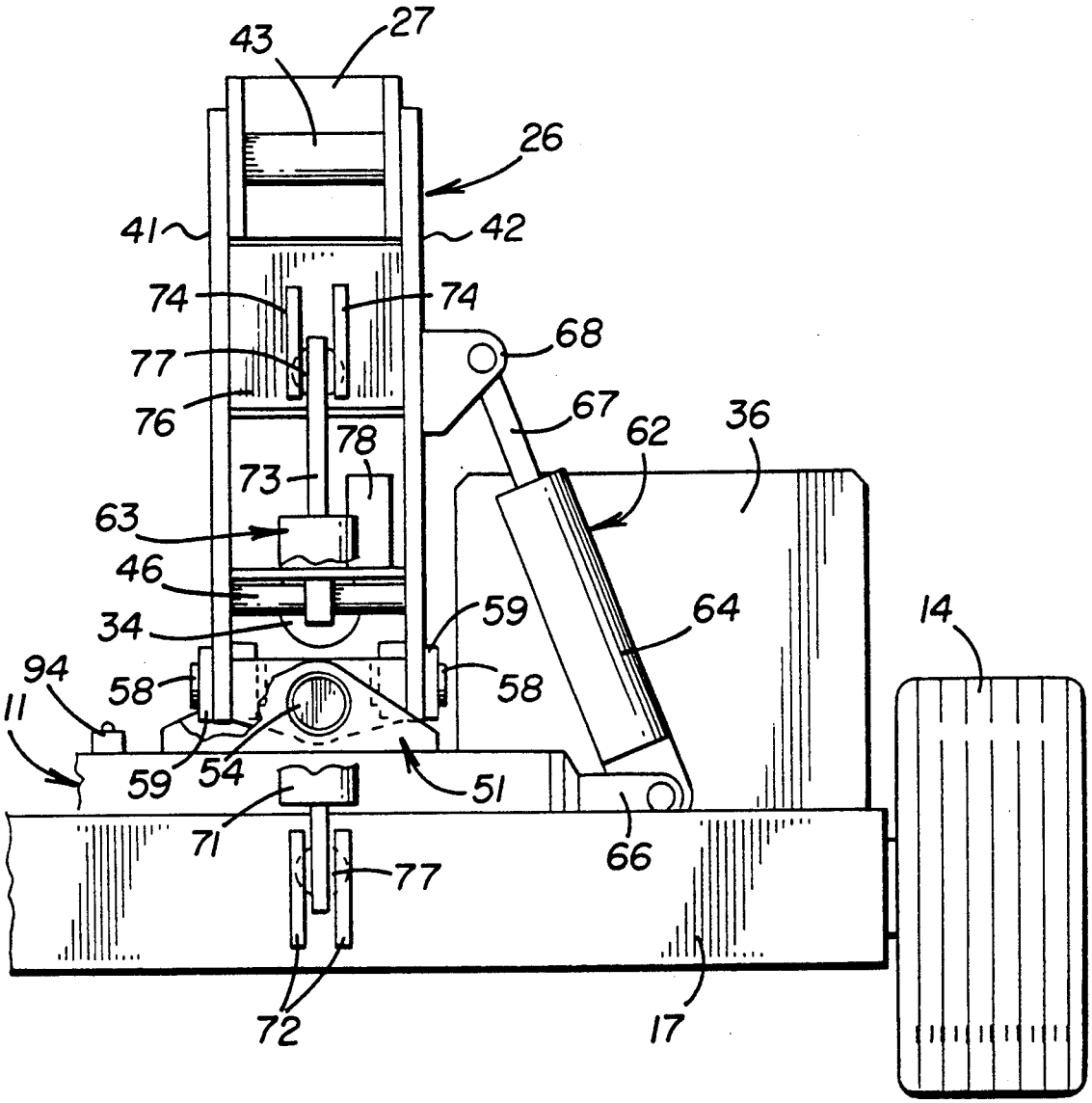
FIG. 5 is a partial view of the rear end of the vehicle of FIG. 1.

In the particular embodiment shown herein, an intermediate rectangular frame member 51 (FIG. 3) is used, this frame member having front and rear plates 52 and side plates 53. The intermediate frame member 51 is pivotally mounted to chassis 11 by a shaft 54 which extends through support brackets 56 and through apertures 57 in the front and rear plates of frame member 51. The brackets 56 are fixed to chassis 11 and oriented so that the axis of shaft 54 extends fore and aft of the vehicle 10.

The pedestal 26 is pivotally mounted on the intermediate frame member 51 by stub shafts 58 which are fixed by retainers 59 to the side plates 41 and 42 of the pedestal and extend through apertures 61 in the side plates 53 of the intermediate frame member 51.

Hydraulic rams 62 and 63 are provided to pivot the pedestal 26 relative to chassis 11. The cylinder 64 of ram 62 is connected at its lower end to brackets 66 on chassis 11 while its rod 67 is connected at its upper end to brackets 68 on a side plate 42 of the pedestal, so that extension and retraction of rod 67 will cause the pedestal to pivot about the fore-and-aft axis of shaft 54. The cylinder 71 is connected at its lower end to brackets 72 on chassis 11 while its rod 73 is connected to brackets 74 on cross brace 76 of the pedestal 26, so that extension and retraction of the rod 73 will cause the pedestal 26 to pivot about the side-to-side axis of stub shafts 58. Spherical bearings 77 are used to connect hydraulic rams 62 and 63 to brackets 66, 68, 72, and 74 to enable the axis of the rams to incline relative to the chassis and pedestal during pivotal movement of the pedestal relative to the chassis.

A multi-axis level sensor 78 is mounted on shelf 79 of pedestal 26 to sense the levelness of the pedestal.

Figure 7:
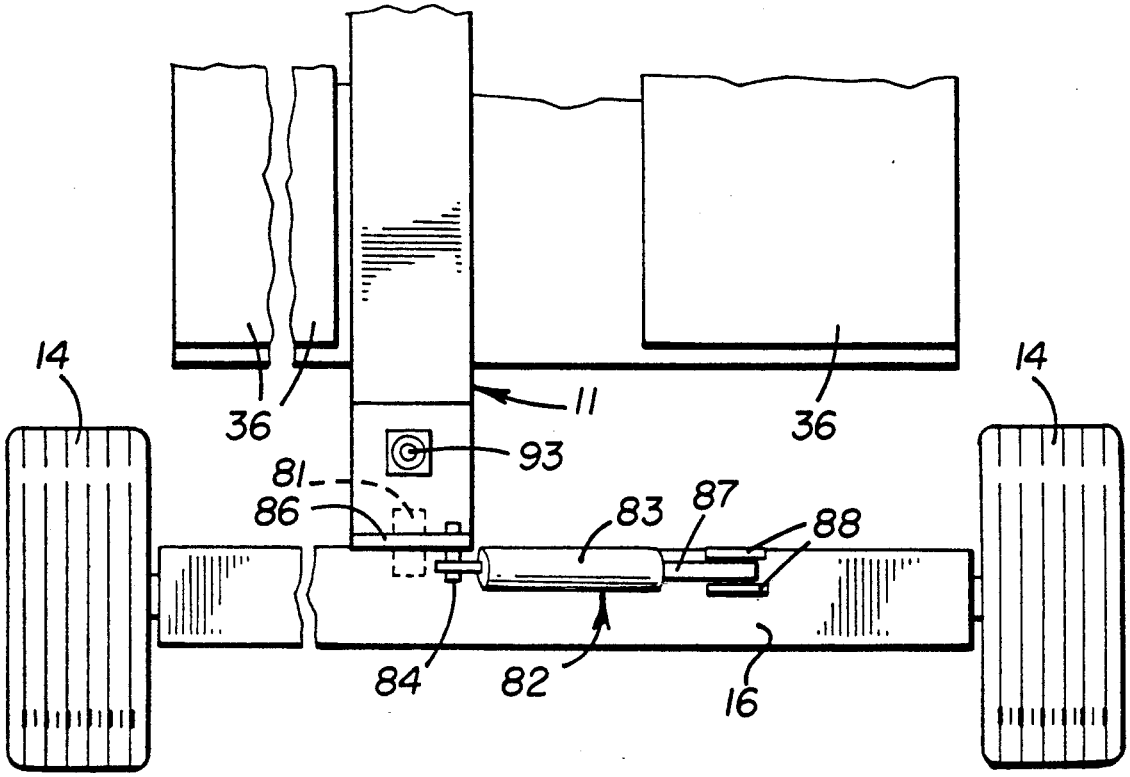
FIG. 7 is a partial plan view of the front end of the vehicle of FIG. 1.
Figure 6:
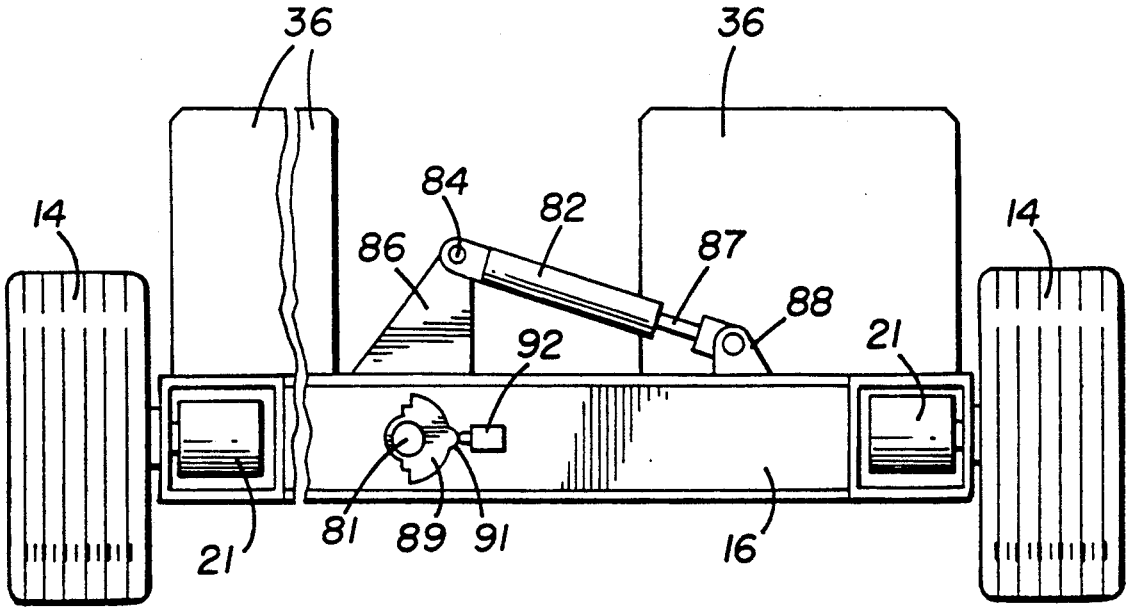
FIG. 6 is a partial view of the front end of the vehicle of FIG. 1.

Referring now to FIGS. 6 and 7, the front axle 16 is mounted on pivot pin 81 so that the front axle can pivot about an axis extending fore and aft of the vehicle. A hydraulic ram 82 has its cylinder 83 connected to pin 84 on chassis bracket 86, and its rod 87 connects to brackets 88 on the front axle 16. As brought out below, the head and rod ends of cylinder 83 can be connected for free fluid flow between the ends of the cylinder. In such case, the front axle can float relative to the chassis so that the front wheels can move up or down relative to the chassis, and in opposite directions, to enable all four wheels to engage the ground at all times even though the ground may be uneven. As the front axle pivots relative to the ground, the rod 87 is pushed or pulled freely into or from cylinder 83. A floating axle will, of course, decrease the stability of the vehicle. When it is desired to raise the platform, fluid flow between the head and rod ends of cylinder 83 is blocked to lock the rod against movement into or from the cylinder so that the front axle is locked against pivotal movent relative to chassis 11. With the front axle locked, the base of the vehicle is thus defined by the contact points of the four wheels with the ground.

A suitable sensor is provided to sense when the front axle is square relative to the chassis. For example, the shaft 81, which is stationary relative to chassis 11, may have a sector plate 89 fixed thereto with a cam lobe 91 adapted to engage microswitch 92 on the front axle when the front axle is square with the chassis.

Two "platform-lowered" microswitches 93 and 94 are mounted on chassis 11, at the front and rear ends thereof respectively, and positioned to be engaged by suitable portions of the elevating assembly 22 when the platform has been fully lowered. A suitable "platform-raised" sensor 96 (FIG. 8) is provided to sense when the platform 24 has been raised a predetermined amount, e.g., six inches or so, from the chassis. For example, sensor 96 may respond to a predetermined amount of extension of the platform lift ram 34.

The operation of the vehicle 10 is best explained with reference to the electrical and hydraulic circuits shown in FIG. 8. Assume that the platform is fully lowered. In such case, switch 97 (actuated by the platform-raised sensor 96 and one or both of the platform-lowered switches 93 and 94 will be in the positions shown. Power is applied to the solenoid of valve 98 which shifts from the position shown to one that interconnects the head and rod ends of the front axle lock ram 82 so that the front axle may float relative to chassis 11. Power is also applied to the solenoid of creep speed valve 99, moving it from the position shown to a position blocking flow therethrough.

Power is also applied through diode 101 to the drive control switch 102. The operator can choose to move forwardly or rearwardly by actuating switch 102 to energize the appropriate solenoid of the three-way spring-centered valve 103 so that hydraulic fluid from pump 104 will flow through drive motor 21 in the proper direction. For purposes of simplicity, only one of the four drive motors 21 is shown in FIG. 8. The speed of the motor can be controlled by the operator by adjustment of the variable flow restrictor 106.

The vehicle can now be driven to the desired work station. Let it be assumed that the ground is not level at that location. Because of the floating front axle, all four wheels will be in full ground engagement. The operator will now level the pedestal by use of the three-way switches 107 and 108 which will energize the appropriate solenoid of the three-way spring-centered valves 111 and 112 to cause extension or retraction of the for-and-aft ram 62 or the side-to-side ram 63. A suitable bubble indicator or the like (not shown) will be provided at the control panel 37 s that the operator can tell when the pedestal (and platform) have become leveled.

The operator may now actuate the ganged raise and lower switches 113 and 114 to "raise" position. Power is then applied through diode 11 to the solenoid of the "raise" valve 117. Hydraulic fluid can now flow through valve 117 and check valve 118 to the head end of the lift ram 34 causing extension of the ram and raising of the platform.

As soon as the elevating assembly has moved up off of microswitches 93 and 94, these switches will open and power will be cut off from the solenoids of valves 98 and 99. Valve 98 moves to the position shown and locks the front axle against pivotal movement relative to the chassis. Continued upward movement of the platform will cause the platform-raised sensor 96 to move switch 97 from the position shown. If the pedestal 26 is indeed level, in all directions, the multi-axis sensor 78 on the pedestal will close switch 119 so that power is still available at the "raise" switch 113. The operator can now raise the platform to the desired height. When the work is completed, the operator can then move the "lower" switch 114 to the position wherein power is supplied to the solenoid of the two-way valve 121. Fluid from the head end of ram 34 can now dump through flow restrictor 122 and valve 121 so that the platform can lower.

If the chassis is not level fore and aft, the lowered elevating assembly will engage either the front or the rear microswitch 93 or 94 (depending on which is uphill relative to the other). Closure of either switch will re-energize the solenoids of valves 98 and 99 and will enable the drive motor 21 to be powered so that the vehicle can be driven and moved to another location.

Figure 8:
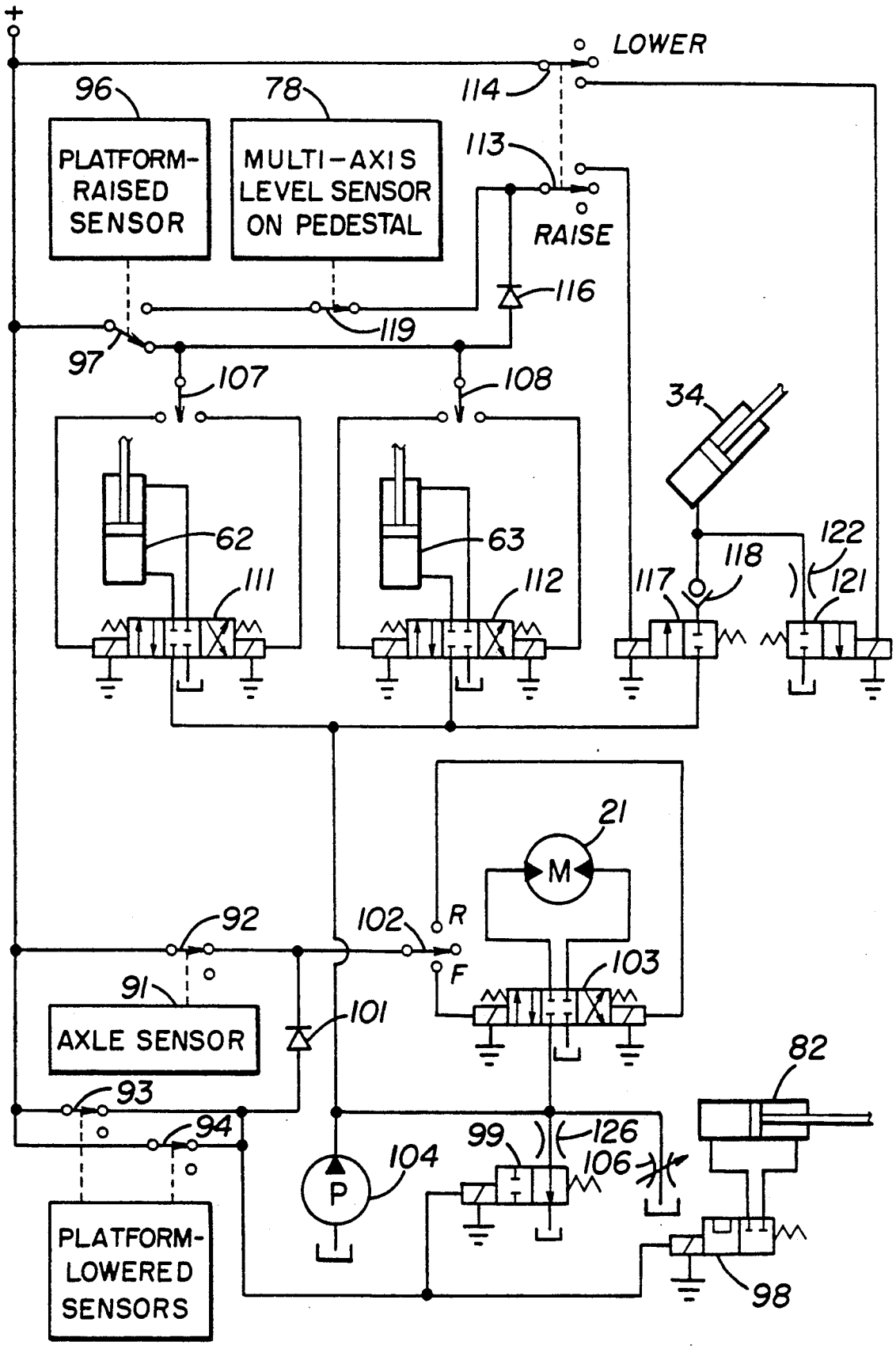
FIG. 8 is a combined diagram of the electrical and hydraulic circuits of the vehicle of FIG. 1.

The control system of FIG. 8 also enables the vehicle to be driven at a low creep speed with the platform elevated, provided that the vehicle is on a level floor or inclined ramp with all four wheels in contact with a planar surface. In such case, the front axle will not be cocked relative to the chassis and microswitch 92 will be closed by cam lobe 91. Power is available at the drive switch 102 with the platform elevated but the vehicle can only be driven at a low creep speed because part of the hydraulic fluid to the motor will be dumped through restrictor 126 and creep valve 99.

When the vehicle is on an uneven surface, with the front axle cocked relative to the chassis, the microswitch 92 will have been moved from engagement with cam lobe 91 so that the vehicle cannot be driven with the platform elevated.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others in the art to best utilize the invention in various embodiments and with various modifications as are suited to the particular use contemplated. It is intended the scope of the invention be defined by the claims appended hereto.

We claim:

1. A mobile aerial lift vehicle, comprising:

(a) an elongated chassis having front and rear ends, (b) two laterally-spaced ground engaging wheels mounted on each end of said chassis, (c) a pedestal, (d) means mounting said pedestal on said chassis for pivotal movement of said pedestal about an axis extending generally fore and aft of said chassis, (e) means for pivoting said pedestal about said axis, (f) a work platform, (g) elevating means mounted on said pedestal for raising and lowering said platform and for maintaining the center of gravity of said platform within the base area determined by said wheels during raising and lowering of said platform, (h) means at one end of said chassis for mounting at least one of said wheels at that end of said chassis for vertical movement relative to said chassis so that all wheels may be engaged with ground that is uneven, (i) means for releasably locking the wheels at said one end of said chassis against vertical movement relative to said chassis.

2. A mobile aerial lift vehicle as set forth in claim 1, wherein said means at one end of said chassis for mounting at least one of said wheels at that end of said chassis for vertical movement relative to said chassis so that all wheels may be engaged with ground that is uneven includes an axle at said one end of said chassis, said wheels at that end of said chassis being mounted at opposite ends of said axle, and means mounting said axle intermediate its ends to said chassis for pivotal movement about a third axis extending fore and aft of said chassis, and wherein said means for releasably locking the wheels at said one end of said chassis against vertical movement relative to said chassis includes means for alternatively allowing said axle to pivot about said third axis or for locking said axle against pivotal movement about said third axis.

3. A mobile aerial lift vehicle as set forth in claim 2, wherein said means for pivoting said pedestal about said axis includes a hydraulic cylinder and a valve means for reversibly connecting hydraulic fluid to said hydraulic cylinder.

4. A mobile aerial lift vehicle, comprising:

(a) an elongated chassis having front and rear ends, (b) two laterally-spaced ground engaging wheels mounted on each end of said chassis, (c) a pedestal, (d) means mounting said pedestal on said chassis for pivotal movement of said pedestal about a first axis extending generally fore and aft of said chassis and for pivotal movement of said pedestal about a second axis extending generally from side to side of said chassis, (e) first means for pivoting said pedestal about said first axis, (f) second means for pivoting said pedestal about said second axis, (g) a work platform, (h) elevating means mounted on said pedestal for raising and lowering said platform and for maintaining the center of gravity of said platform within the base area determined by said wheels during raising and lowering of said platform when said pedestal is level, (i) means at one end of said chassis for mounting at least one of said wheels at that end of said chassis for vertical movement relative to said chassis so that all wheels may be engaged with ground that is uneven, (j) means for releasably locking the wheels at said one end of said chassis against vertical movement relative to said chassis.

5. A mobile aerial lift vehicle as set forth in claim 4, wherein said means at one end of said chassis for mounting at least one of said wheels at that end of said chassis for vertical movement relative to said chassis so that all wheels may be engaged with ground that is uneven includes an axle at said one end of said chassis, said wheels at that end of said chassis being mounted at opposite ends of said axle, and means mounting said axle intermediate its ends to said chassis for pivotal movement about a third axis extending fore and aft of said chassis, and wherein said means for releasably locking the wheels at said one end of said chassis against vertical movement relative to said chassis includes means for alternatively allowing said axle to pivot about said third axis or for locking said axle against pivotal movement about said third axis.

6. A mobile aerial lift vehicle as set forth in claim 4, and further including:

means for enabling said assembly to be driven at full speed when said platform is in a lowered position relative to said chassis, means for preventing said assembly from being driven when said platform is in a raised position relative to said chassis and said ground engaging wheels are on uneven ground, means for enabling said assembly to be driven at a reduced speed only when said platform is in a raised position relative to said chassis, and said chassis is level, and said ground engaging wheels are all on a planar surface.

7. A mobile aerial lift vehicle as set forth in claim 4, wherein said means mounting said pedestal on said chassis includes:

an intermediate frame, means mounting said intermediate frame to said chassis for pivotal movement of said intermediate frame relative to said chassis solely about an axis which is one of said first and second axes, means mounting said pedestal on said intermediate frame for pivotal movement of said pedestal relative to said intermediate member solely about an axis which is the other of said first and second axes.

8. A mobile aerial lift vehicle as set forth in claim 7, wherein said first and second means for pivoting said pedestal each includes a hydraulic cylinder and a valve means for reversibly connecting hydraulic fluid to said hydraulic cylinder.

9. A mobile aerial lift vehicle as set forth in claim 7, wherein said means at one end of said chassis for mounting at least one of said wheels at that end of said chassis for vertical movement relative to said chassis so that all wheels may be engaged with ground that is uneven includes an axle at said one end of said chassis, said wheels at that end of said chassis being mounted at opposite ends of said axle, and means mounting said axle intermediate its ends to said chassis for pivotal movement about a third axis extending fore and aft of said chassis, and wherein said means for releasably locking the wheels at said one end of said chassis against vertical movement relative to said chassis includes means for alternatively allowing said axle to pivot about said third axis or for locking said axle against pivotal movement about said third axis.

10. A mobile aerial lift vehicle as set forth in claim 7, and further including:

means for enabling said assembly to be driven at full speed when said platform is in a lowered position relative to said chassis, means for preventing said assembly from being driven when said platform is in a raised position relative to said chassis and said ground engaging wheels are on uneven ground, means for enabling said assembly to be driven at a reduced speed only when said platform is in a raised position relative to said chassis and said ground engaging wheels are all on a planar surface.

11. A mobile aerial lift vehicle, comprising:

(a) an elongated chassis having front and rear ends, (b) two laterally-spaced ground engaging wheels mounted on each end of said chassis, (c) a pedestal, (d) means mounting said pedestal on said chassis for pivotal movement of said pedestal about a first axis extending generally fore and aft of said chassis and for pivotal movement of said pedestal about a second axis extending generally from side to side of said chassis, (e) first means for pivoting said pedestal about said second axis, (f) second means for pivoting said pedestal about said second axis, (g) a work platform, (h) elevating means mounted on said pedestal for raising and lowering said platform and for maintaining the center of gravity of said platform within the base area determined by said wheels during raising and lowering of said platform when said pedestal is level, (i) means for enabling said assembly to be driven at full speed when said platform is in a lowered position relative to said chassis, (j) means for preventing said assembly from being driven when said platform is in a raised position relative to said chassis and said ground engaging wheels are on uneven ground, (k) means for enabling said assembly to be driven at a reduced speed only when said platform is in a raised position relative to said chassis and said ground engaging wheels are all on a planar surface.

12. A mobile aerial lift vehicle as set forth in claim 11, wherein said means for mounting said pedestal on said chassis includes:

an intermediate frame, means mounting said intermediate frame to said chassis for pivotal movement of said intermediate frame relative to said chassis solely about an axis which is one of said first and second axes, means mounting said pedestal on said intermediate frame for pivotal movement of said pedestal relative to said intermediate member solely about an axis which is the other of said first and second axes.

* * * * *